US005184637A

United States Patent [19]

Kowis

[11] Patent Number: 5,184,637

[45] Date of Patent: Feb. 9, 1993

[54] PAINT BRUSH AND ROLLER CLEANER

[76] Inventor: Kenneth L. Kowis, 3709 Ashurst St., Twenty-Nine Palms, Calif. 92278

[21] Appl. No.: 573,331

[22] Filed: Aug. 27, 1990

[51] Int. Cl.[5] ..... B08B 3/02

[52] U.S. Cl. ..... 134/182; 134/201; 134/900

[58] Field of Search ..... 134/200, 201, 182, 138, 134/900; 68/213; 401/261

[56] References Cited

U.S. PATENT DOCUMENTS

| | | | |
|---|---|---|---|
| 1,982,518 | 11/1934 | Howard | 134/199 UX |
| 2,768,635 | 10/1956 | Redmond | 134/122 R X |
| 2,826,209 | 3/1958 | Klein et al. | 134/122 R X |
| 2,831,488 | 4/1958 | Anderson | 68/213 UX |
| 2,985,178 | 5/1961 | Christensen, Jr. | 134/199 X |
| 4,402,333 | 9/1983 | Frizzell et al. | 134/138 |
| 4,509,545 | 4/1985 | Trotter | 134/199 |
| 4,517,699 | 5/1985 | Petricka | 134/199 X |
| 4,606,777 | 8/1986 | Brow | 134/199 |
| 4,723,564 | 2/1988 | West | 134/199 X |
| 4,738,273 | 4/1988 | Giacometti | 134/122 R X |

*Primary Examiner*—Frankie L. Stinson

[57] ABSTRACT

A painting implement flushing device is designed for use with both paint rollers and paint brushes, and will also work with sponge brushes. The unit connects to a garden hose, and comprises a toroidal irrigation ring with ports on the inner surface, and upper and lower plates which sandwich the toroid therebetween to define a flushing department. The upper and lower plates have pass-through openings dimensioned to receive the cylindrical portion of a roller, or the bristles of a brush, with the upper plate being dimensioned to fairly snugly fit the painting implement, and the lower plate having a plurality of apertures to drain the flushing water from the flushing chamber.

6 Claims, 2 Drawing Sheets

PAINT BRUSH AND ROLLER CLEANER

BACKGROUND OF THE INVENTION

Anyone who has done any painting at all will acknowledge the problem of rinsing the paint from either brushes or rollers. Professional painters who must change colors throughout the day or week have an even tougher problem. It is often very difficult to rinse out all the paint from a roller or brush. When doing so it seems like there is an unlimited quantity of paint embedded deep within the nap of the roller or the bristles of the brush, as it seems to continuously flush out with the water even after a minute or two of hard flushing.

This relative ineffectiveness of the typical flushing technique, which involves holding the brush or roller under a faucet, is due in large part to the lack of anything that would force the water deep into the nap of the roller or into the bristles of the brush. The result is that it is often easier, especially for a professional painter, to throw away a roller and use a different one for a different color, rather than trying to clean the original roller. Even at a couple of dollars per unit, the cost mounts up, and adds additional waste to the already overburdened waste facilities of our consumer society.

There have been automatic roller cleaners produced and marketed. Typically, these are devices that provide a constant flow of water directed at the nap of the roller. In some cases, these devices are designed for unattended operation, such as the devices disclosed in U.S. Pat. No. 4,172,373 and 2,831,488. Other devices, such as that disclosed in U.S. Pat. No. 2,285,178 are designed to be used with an operator in attendance. These devices are typically messy to use, and in the case of those devices designed for unattended operation, are slow.

There is a need for an efficient and effective paint brush and roller cleaner, which can be used with the existing water hookups almost all residential and commercial establishments.

SUMMARY OF THE INVENTION

The instant invention fulfills the above-stated need and comprises a brush and roller flusher which can be adapted for use on any size roller and almost any size paint brush.

The flusher consists of a tubular ring with a valved female connection adapted to fit a garden hose. The inside of the ring is provided with irrigation ports, and bottom and top plates sandwich the ring therebetween to define a flushing chamber with the ring.

Both top and bottom plates have circular pass-through openings to pass therethrough paint rollers, and additional, substitute plates with slotted openings are available for use in cleaning brushes.

The opening in the top plate is dimensioned to snugly fit the roller or bristle portion of a brush, and the aperture in the bottom plate is the same as the top except that it can be larger, and the bottom plate is provided with drain apertures as well.

When the hose is connected and turned on, the water gushes into the flushing chamber, and is prevented from squirting upward because of the top plate, but is free to fall through the drain apertures in the bottom plate after it has swirled around the roller or brush to some extent.

DETAILED DESCRIPTION OF THE PREFERRED EMBODIMENT

The annular or toroidal irrigation loop is shown at 10. This loop is the same in both embodiments, and is interiorly hollow with a plurality of irrigation ports 12 angularly spaced around the interior wall of the loop. At one sided is a female inlet 14 with a turn-off valve 16, so that the unit can be connected to any garden hose. The loop or ring 10 can be made of plastic or aluminum or any other suitable material.

Figure 1:
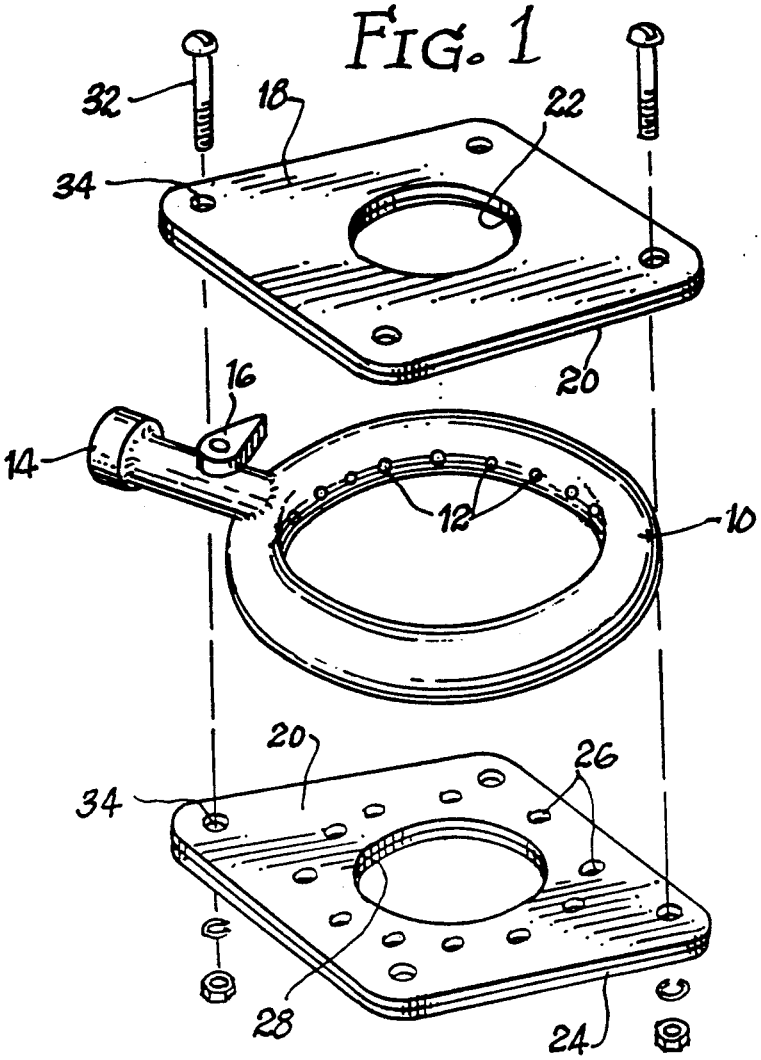
FIG. 1 is an exploded perspective view of the flushing device in its roller cleaning mode.
Figure 2:
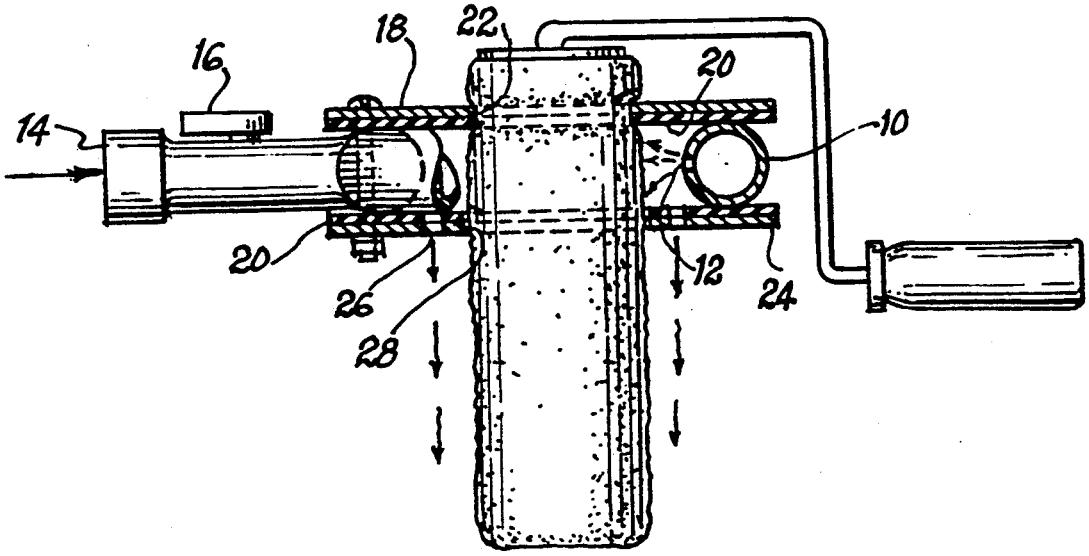
FIG. 2 is a section taken through portions of the roller cleaning device showing a roller being cleaned thereby.

In addition to the loop, referring to FIGS. 1 and 2, there is a top plate 18 which in the illustrated embodiment has a rubber seal 20 on the bottom, and a central, circular aperture 22.

A bottom plate 24 is similar to plate 18 except that it defines a plurality of drain apertures 26 in addition to the central opening 28. The aperture 28 may be somewhat larger than aperture 22, as shown in FIG. 2. This is because, whereas water should not squirt up through the top plate 18, it is free to drain down through the plate 24 anyway because of the apertures 26, and making the opening 28 somewhat larger than opening 22 would make it easier to push the roller through the device.

In use, the roller would be inserted through the apertures 22 and 28, and then the water turned on. As shown in FIG. 2, the water will flow through the ports 12, flushing the area of the roller inside the flushing chamber 30, and then draining down through the drain apertures 26. The water could obviously contain dissolved cleaning substances, and conceivably a solvent other than water could be used, for example in the event oil-based paint is used.

Any means of compressing the two plates 18 and 24 together to sandwich the ring 10 therebetween might be used, but a simple expedient might be the utilization of the bolts 32 which pass through bolt holes 34 in the plates and are secured by nuts and washers.

Figure 3:
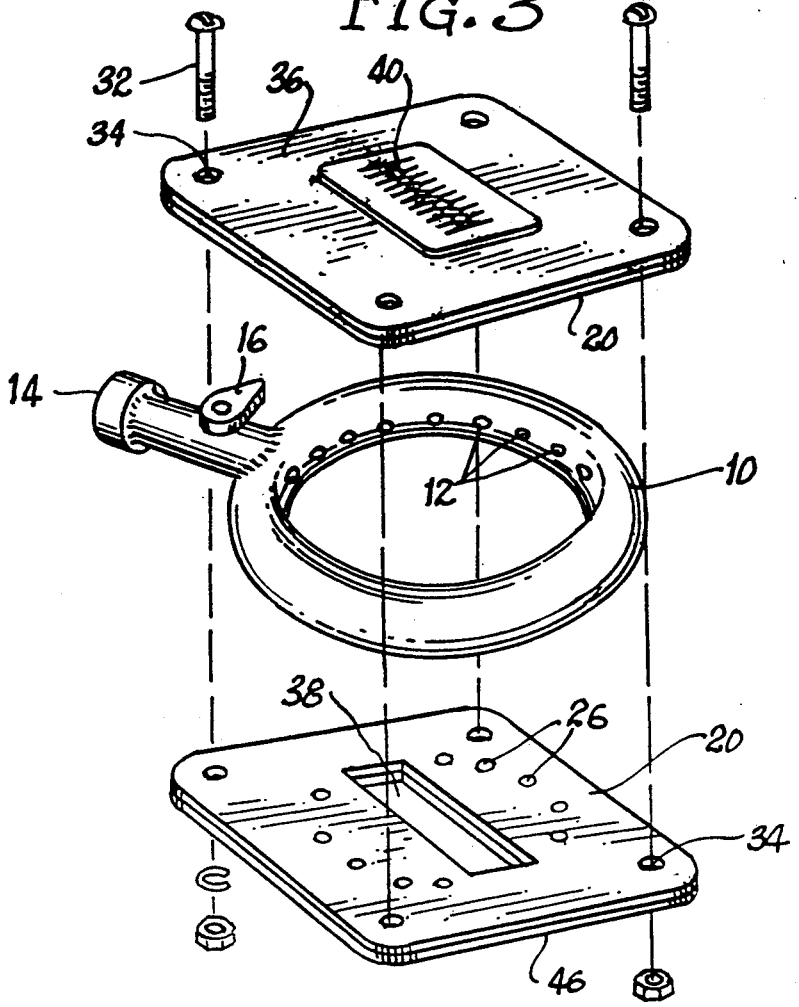
FIG. 3 is an exploded perspective view of the device utilizing the brush cleaning plates; and, FIG. 4 is a section taken through the device showing a brush being pulled through and cleaned.
Figure 4:
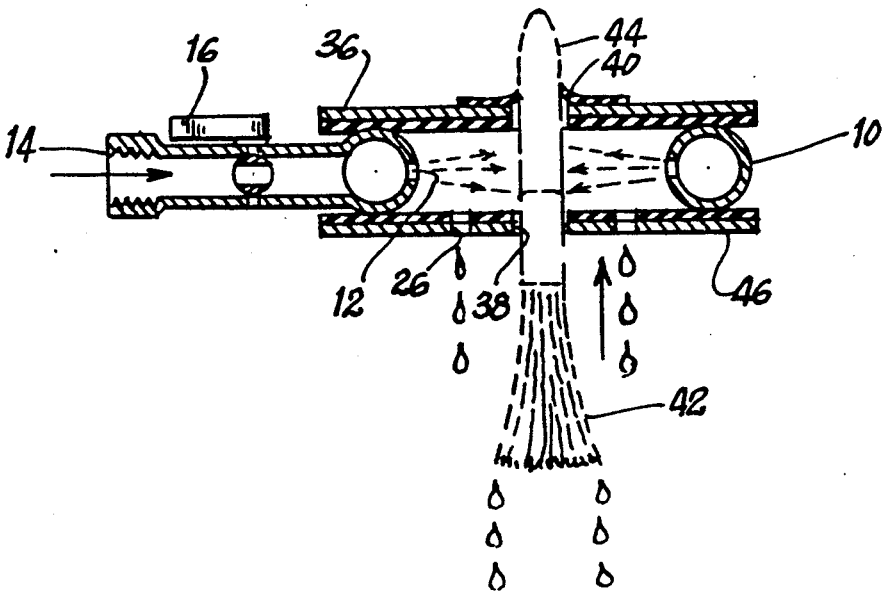

This technique of connecting the two plates also expedites changing the plates in the event that the second embodiment, illustrated in FIGS. 3 and 4, is used. In this embodiment, the top plate 36 is virtually identical to the top plate 18 of the first embodiment except that the interior opening is slotted at 38 rather than being circular. In the preferred embodiment, this slot is also covered with a pair of inwardly projecting, toothed flaps 40 which project against the bristles of the brush 42, both to effectively seal the bristles to prevent upward squirting of water from the flushing chamber, and also to extend into the inner reaches of the brush to help flush it out. These flaps could be part of a panel of rubber bolted, or bonded to the plate as shown.

As shown in FIG. 4, in the second embodiment the brush would ordinarily be pushed up from the bottom, with the handle 44 extended up through the flaps 40. The handle would be pulled until the bristles themselves are aligned with the flaps, and then the irrigation water would be turned on, and the brush slowly pulled out to flush the bristles from top to bottom.

The bottom plate 46 is again similar to plate 24 except for the slot 38, which again may be slightly larger than the opening in the upper plate.

In either embodiment, the invention provides a long-needed, simple and inexpensive means for the home-owner, the professional painter and anyone else to effectively and quickly clean both brushes and rollers with a minimum of aggravation and cost.

It is hereby claimed:

1. A paint implement flushing device comprising (a) an irrigation tube loop having a plurality of inwardly directed irrigation ports, said loop being of greater internal diameter than the diameter of the paint-carrying portion of the implement to be flushed, and having a flushing fluid inlet;

(b) a removable pair of top plates each having a first opening therein large enough to pass at least the paint-carrying portion of an implement to be flushed therethrough;

(c) a removable pair of bottom plates each having a second opening similar to and aligned with the first opening in the respective one of said top plates;

(d) means compressing said plates together on the respective top and bottom of said loop to define a flushing chamber therebetween, such that a painting implement having its paint carrying portion disposed in said chamber is flushed by fluid introduced into said chamber from said flushing fluid inlet; and, (e) one of said top plates and the corresponding respective bottom plate being characterized by said respective first and second openings being circular to accommodate a paint roller, and the other of said top plates and its corresponding respective bottom plate being characterized by said first and second openings being slots to accommodate the bristle portion of a paint brush, such that said top plates and bottom plates define two interchangeable plate sets which can be interchanged on said flushing device to selectably flush either a paint roller or a paint brush.

2. A paint implement flushing device comprising (a) an irrigation tube loop having a plurality of inwardly directed irrigation ports, said loop being of greater internal diameter than the diameter of the paint-carrying portion of the implement to be flushed, and having a flushing fluid inlet;

(b) a top plate having a first opening therein dimensioned to seal against the paint-carrying portion of an implement to be flushed therethrough;

(c) a bottom plate having a second opening similar to and aligned with said first opening;

(d) means compressing said plates together on the respective top and bottom of said loop to define a substantially sealed flushing chamber therebetween, such that a painting implement having its paint-carrying portion disposed in said chamber is flushed by fluid introduced into said chamber from said flushing fluid inlet; and, (e) said bottom plate defining a plurality of drain apertures to permit the egress of used flushing water from said flushing chamber.

3. A paint implement flushing device comprising (a) an irrigation tube loop having a plurality of inwardly directed irrigation ports, said loop being of greater internal diameter than the diameter of the paint-carrying portion of the implement to be flushed, and having a flushing fluid inlet;

(b) a top plate having a first opening therein large enough to pass at least the paint-carrying portion of an implement to be flushed therethrough;

(c) a bottom plate having a second opening similar to and aligned with said first opening;

(d) means compressing said plates together on the respective top and bottom of said loop to define a flushing chamber therebetween, such that a painting implement having its paint-carrying portion disposed in said chamber is flushed by fluid introduced into said chamber from said flushing fluid inlet; and, said first and second openings being slots to accommodate the bristle portion of a paint brush.

4. Structure according to claim 3 wherein the slot in said top plate is provided with at least one inwardly directed flexible flap to at least partially seal said first opening against the bristles of a paintbrush as same is drawn therethrough.

5. Structure according to claim 4 wherein at least one of said flaps is toothed.

6. Structure according to claim 5 wherein slot is provided with two opposed flapps and each of said flaps is provided with pointed teeth directed at the teeth of the other of said flaps.

* * * * *